US006217386B1

(12) United States Patent
Zhang

(10) Patent No.: US 6,217,386 B1
(45) Date of Patent: Apr. 17, 2001

(54) CONNECTOR WITH EASILY MATING GROUNDING CONTACT

(75) Inventor: Guohua Zhang, Kun-San (CN)

(73) Assignee: Hon Hai Precision Ind. Co., Ltd., Taupei Hsien (TW)

( * ) Notice: Subject to any disclaimer, the term of this patent is extended or adjusted under 35 U.S.C. 154(b) by 0 days.

(21) Appl. No.: 09/474,350

(22) Filed: Dec. 29, 1999

(30) Foreign Application Priority Data

Oct. 29, 1999 (TW) ..... 88218474

(51) Int. Cl.[7] ..... H01R 13/648

(52) U.S. Cl. ..... 439/608; 439/95; 439/786

(58) Field of Search ..... 439/607–610, 439/541.5, 939, 108, 95, 540.1, 786

(56) References Cited

U.S. PATENT DOCUMENTS

| | | | | |
|---|---|---|---|---|
| 6,074,223 | * | 6/2000 | Huang | 439/95 |
| 6,095,824 | * | 8/2000 | McHugh | 439/74 |
| 6,116,926 | * | 9/2000 | Ortega et al. | 439/608 |
| 6,123,583 | * | 9/2000 | Huang | 439/607 |

* cited by examiner

*Primary Examiner*—Khiem Nguyen
(74) *Attorney, Agent, or Firm*—Wei Te Chung

(57) ABSTRACT

An electrical connector of the present invention comprises an insulative housing, a plurality of grounding contacts and a plurality of shells. Each contact comprises an engaging portion forming an S-shaped spring arm punched out of a plane thereof and bent backward and extending in a longitudinal direction. The spring arm of the contact resiliently interferingly fits with a distal end of a retention tab of the shell, in such manner that the grounding contacts can easily connect with shells to produce effective shielding.

6 Claims, 5 Drawing Sheets

CONNECTOR WITH EASILY MATING GROUNDING CONTACT

BACKGROUND OF THE INVENTION

1. The Field of the Present Invention

The present invention relates to a connector, and particularly to an electrical connector whose grounding contacts can easily be connected with shells for producing a good shielding effect.

2. Description of the Prior Art

A conventional connector shown in FIGS. 4–5 comprises an insulative housing 2', a plurality of contacts 1' and a plurality of shell 3'. A pair of crimps 14' are formed on the distal end of the engaging portion 12' of each contact 1'. Being cut from a metal sheet with the contact as a pair of tabs on opposite sides of the contact and then being oppositely bent toward each other produces the two crimps. In assembly each shell 3' covers a protrusion 24' of the housing 2', two retention tabs 32' of the shell 3' being inserted into appropriate arc slots (not shown) in a front wall of the housing 2'. A distal end of each of the retention tab 32' is exposed to a passage 22' of the housing 2' for contacting and interferingly fitting with the crimps 14' of the contact 1' (shown in FIG. 5).

In the prior art the two crimps 14' are small controlled by the breadth of the engaging portion 12' of the contact 1' so that the resiliency is decreased and the rigidity is increased. The distal end of the retention tab 32' forces two crimps 14' open and is inserted therebetween. The contact and the shell firmly fit together but the interacting forces between them are so great that they can be damaged easily. Moreover, the retention forces required between the housing and the shell are great to prevent from separating from the housing during connection. An improved electrical connector is required to overcome the disadvantages of the prior art.

SUMMARY OF THE INVENTION

An object of the present invention is to provide an electrical connector whose contacts can be easily connected with shells.

Other objects, advantages and novel features of the invention will become more apparent from the following detailed description of the present embodiment when taken in conjunction with the accompanying drawings.

A connector in accordance with the present invention comprises an insulative housing, a plurality of contacts and a plurality of shells. The housing has a bottom wall and a front wall forming a plurality of protrusions. A plurality of contact receiving passages is defined through the housing for receiving engaging portions of the contacts. A spring arm is formed on each engaging portion. The spring arm is large compared to the two crimps of the prior art, and thus has sufficient resiliency for resiliently engaging with a retention tab of the shell. The engaging force between the contact and the shell is relatively small and the retention force required between the housing and the shell is not great, so that assembling the contact with the shell while keeping the shell engaged with the housing is easily done. Guide faces are provided on a distal section of the spring arm and on the engaging portion of the contact to aid insertion of the retention tab therebetween.

DETAILED DESCRIPTION OF THE INVENTION

Figure 1:
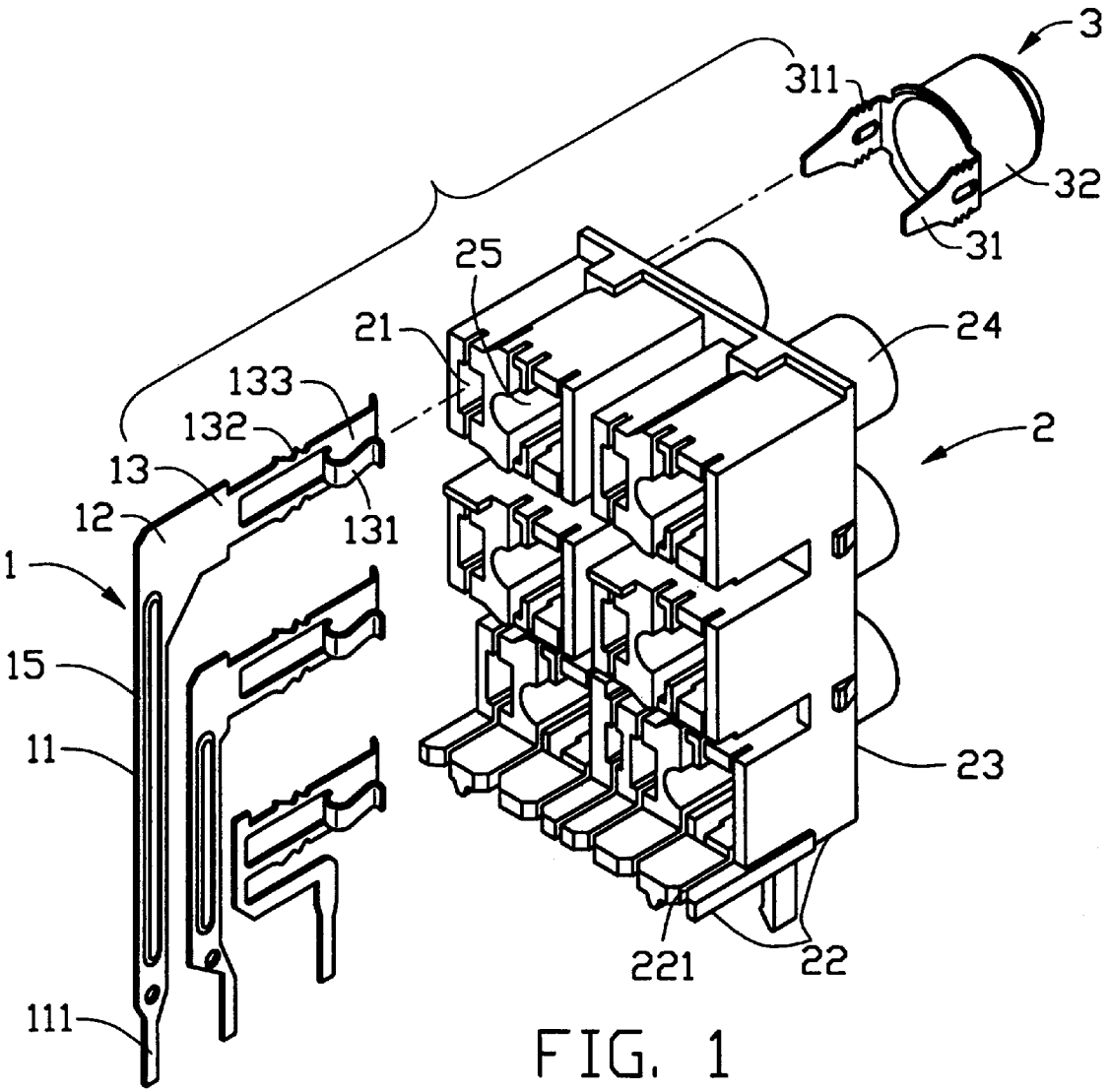
FIG. 1 is an exploded view of an electrical connector in accordance with the present invention.
Figure 2:
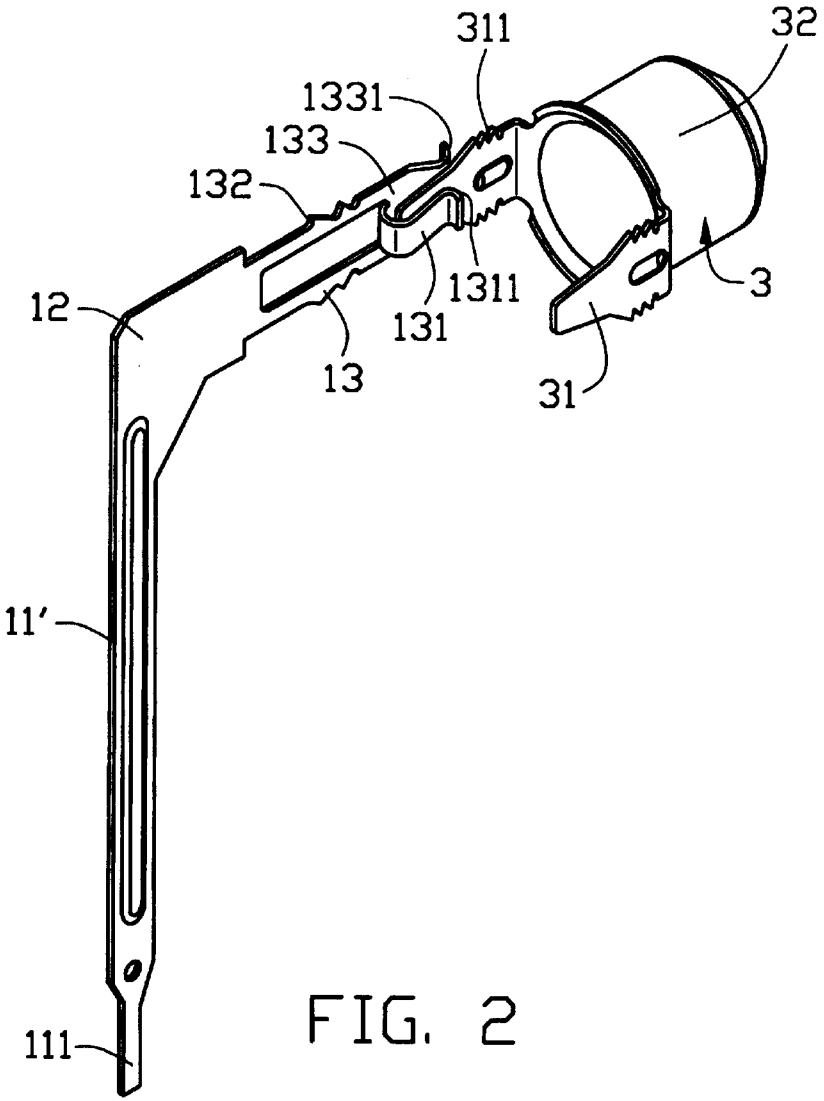
FIG. 2 is a perspective view of an assembly of a contact and a shell of the present invention.

Referring to FIGS. 1–2, an electrical connector in accordance with a present invention comprises an insulative housing 2, a plurality of contacts 1 and a plurality of shells 3.

The housing 2 has a bottom wall 22 and a front wall 23. Slots 221 are defined through the bottom wall 22 for orienting the contacts 1 in the housing 2. A plurality of cylinder-shaped protrusions 24 is formed on the front wall 23. Arc slots (not shown) are defined in the front wall 23 and on both sides of each protrusion 24. A plurality of passages 21, 25 in communication with the arc slots (not shown) is defined through the housing 2.

Figure 3:
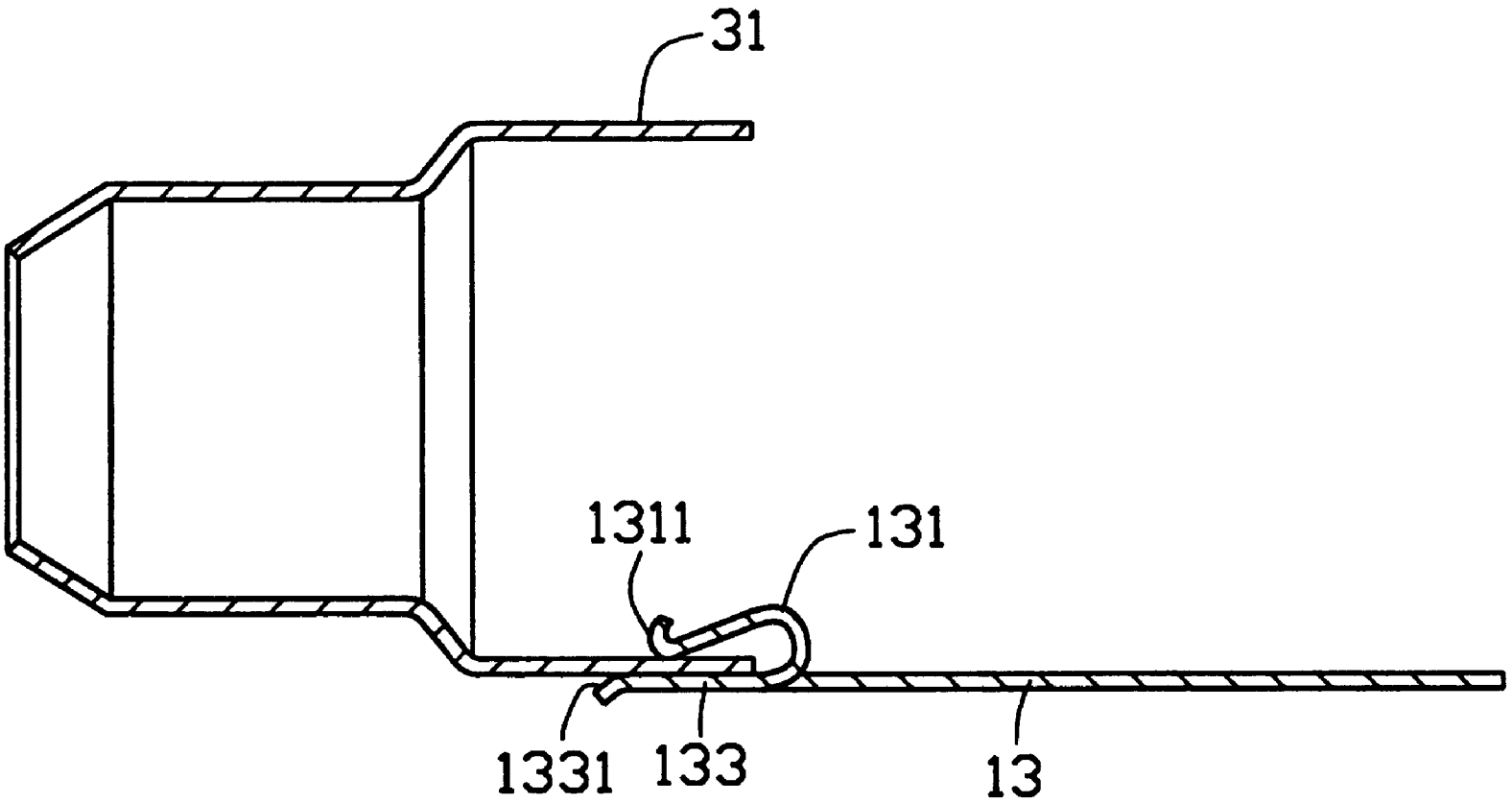
FIG. 3 is a sectional view of a contact and a shell of the present invention in assembly.
Figure 4:
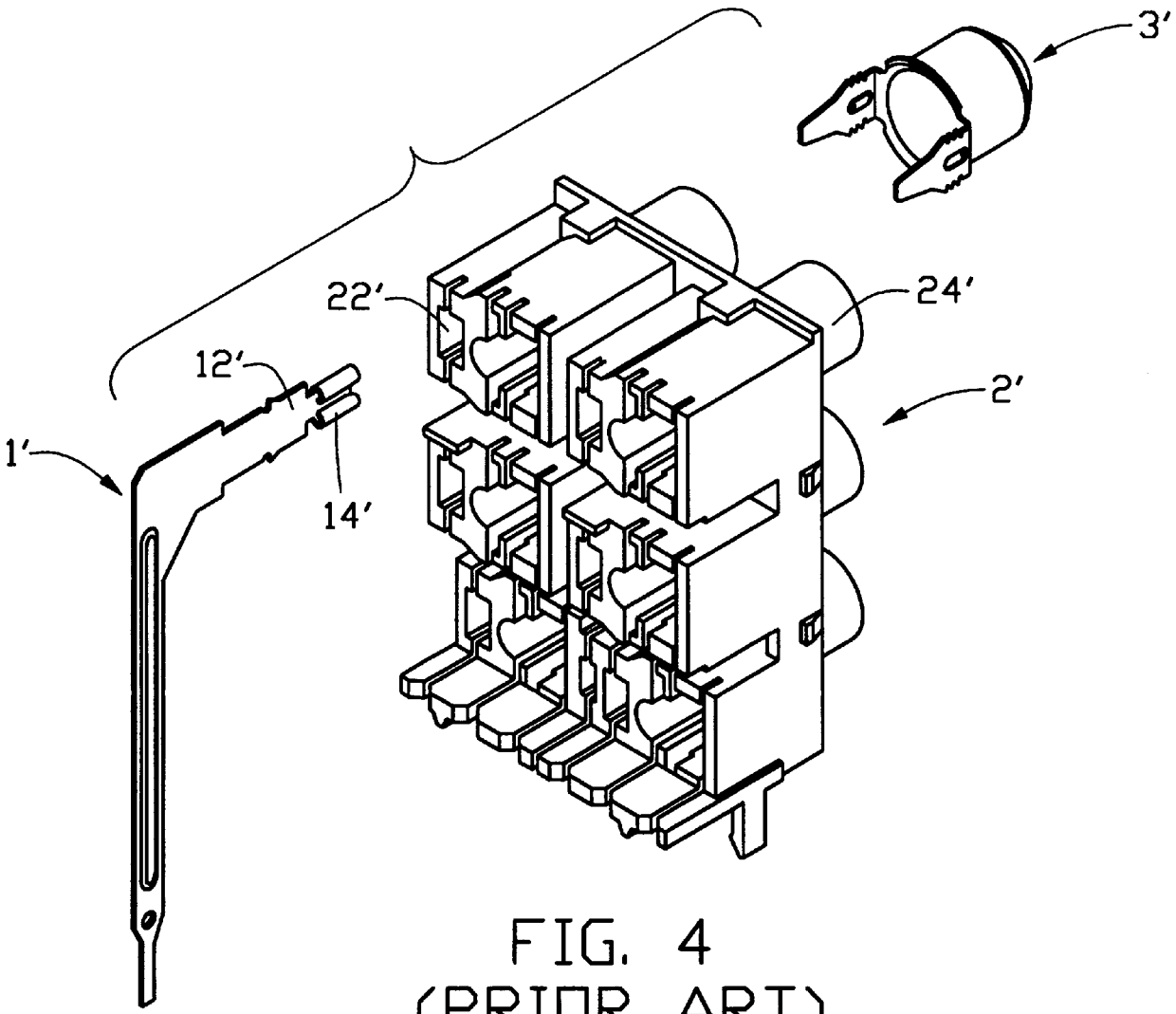
FIG. 4 (PRIOR ART)
FIG. 4 is an exploded view of a conventional electrical connector.
Figure 5:
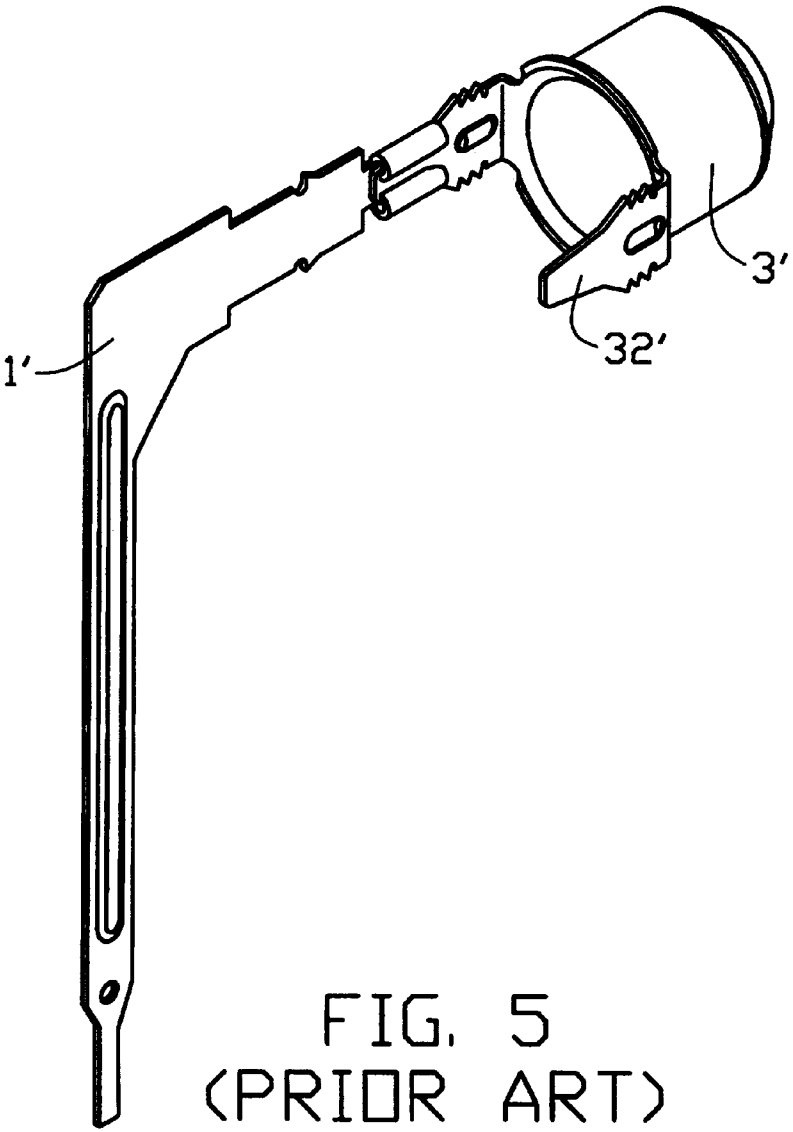
FIG. 5 (PRIOR ART)
FIG. 5 is a perspective view of the conventional contact and shell.

The contacts 1 are of three sizes, which slightly differ from each other in form but not in function. The three sizes aid in keeping the contact separated from each other in assembly in the housing 2. Each contact comprises an extending portion 11 forming a solder tail 111 at a lower portion thereof and a base portion 12 at an opposite portion thereof, and an engaging portion 13 extending horizontally from the base portion 12. The extending portion 11 of the smallest size contact 1 is L-shaped. The engaging portion 13 of each contact 1 has an S-shaped spring arm 131 punched from a plane of the contact and then bent forwardly in a longitudinal direction, whereby an opening 134 is formed and the spring arm 131 integrally extending from a front edge of said opening forwardly. Barbs 132 are formed on an opposite and a lower edge of the engaging portion 13 for interferingly fitting with an inner wall of the contact receiving passage 21 of the housing 2. The engaging portion 13 has a clipping section 133 whose forward edge is bent outward thereby forming a guiding face 1331. As shown in FIG. 3, another guiding face 1311 is formed on a distal edge of the spring arm 131.

The shell 3 is a stamped, formed and deep drawn metal member. A stamping and forming process is used to produce a pair of integral retention tabs 31, which form a plurality of barbs 311 on upper and lower edge thereof for interferingly fitting with an arc slot (not shown) of the housing 2. A shielding portion 32 is produced through a deep drawn process.

In assembly each shell 3 covers a protrusion 24 of the housing 2, the two retention tabs 31 being inserted into arc slots (not shown) on either side of the protrusion 24. A distal end of each retention tab 31 extends into a contact receiving passage 21, 25 of the housing 2. The extending portion 11 of each contact 1 is received in a slot 221, the solder tail 111 extending through the bottom 22 for soldering to a printed circuit board. The engaging portion 13 is received in a corresponding passage 21, the spring arm 131 interferingly fitting with the distal end of the retention tab as shown in FIG. 2.

Referring to FIG. 3 during assembly the retention tab 31 is inserted between the two guide faces 1311 and 1331, and is resiliently clipped and fixed therebetween. Because the forces of engagement are relatively small, The contact 1 and the shell 3 are not damaged during engagement, and retention of the shell 3 and the contact 1 in the housing 2 is not problematic, so assembly is facilitated.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a bottom wall, a front wall, a plurality of contact receiving passages, and a plurality of protrusions formed on the front wall;

a plurality of shells covering the appropriate protrusions of the housing, each shell integrally comprising a shielding portion and a pair of retention tabs; and a plurality of contacts each comprising an extending portion forming a solder tail, a base portion, and an engaging portion extending in a longitudinal direction, a clipping section being formed on the engaging portion, the engaging portion having a spring arm punched out of a plane thereof and bent and extending in the longitudinal direction for receiving a distal end of the retention tab of the shell between the spring arm and the clipping section.

2. The electrical connector as claimed in claim 1, wherein barbs are formed on upper and lower edges of the engaging portion of the contact for interferingly fitting with an inner wall of the passage of the housing.

3. The electrical connector as claimed in claim 1, wherein the spring arm is S-shaped.

4. The electrical connector as claimed in claim 1, wherein each of the spring arm and the clipping sections of the engaging portion has a guiding face formed on a distal section thereof to smooth guide the insertion of the retention tab of the shell therebetween.

5. An electrical connector comprising:

an insulative housing defining a plurality of contact receiving passages therein and a plurality of protrusions thereof; and a plurality of shells each defining a shielding portion covering the corresponding protrusion, and a pair of retention tabs with barbs thereon respectively received within the corresponding contact receiving passage; and a plurality of contacts each defining a solder tail, a base portion, an engaging portion extending forwardly from the base portion, said engaging portion defining a forwardly extending clipping section and a spring arm extending forwardly from a front edge of an opening in said engaging portion, barbs formed by two sides of said opening and interferentially engaged with the corresponding contact receiving passage; wherein the retention tab is sandwiched between the clipping section and the spring arm of the corresponding contact.

6. The connector as claimed in claim 5, wherein in the contacts located in the same vertical plane, tips of the solder tails thereof extend to the same horizontal plane for right angle mounting to a printed circuit board, and the openings and the retention tabs thereof are same with one another for assuring balanced and reliable retention between the contact and the corresponding retention tab of the shell.

* * * * *